US006230356B1

(12) United States Patent
Hyo-Moon

(10) Patent No.: US 6,230,356 B1
(45) Date of Patent: May 15, 2001

(54) TOOTHBRUSH

(76) Inventor: Park Hyo-Moon, 243-1, Sangdae-dong, Jinju (660-320) Kyungsangnam-do (KR)

( * ) Notice: Subject to any disclaimer, the term of this patent is extended or adjusted under 35 U.S.C. 154(b) by 0 days.

(21) Appl. No.: 09/356,828

(22) Filed: Jul. 19, 1999

(30) Foreign Application Priority Data

Jul. 24, 1998 (KR) ..... 98-13990
Jul. 24, 1998 (KR) ..... 98-13991

(51) Int. Cl.[7] ..... A46B 9/04
(52) U.S. Cl. ..... 15/167.1; 15/172; D4/104
(58) Field of Search ..... 15/167.1, 172; D4/104

(56) References Cited

U.S. PATENT DOCUMENTS 1,894,509 * 1/1933 Booth ..... 15/167.1
2,003,243 * 5/1935 Campbell et al. ..... 15/167.1
2,254,365 * 9/1941 Griffith et al. ..... 15/167.1
2,418,344 * 4/1947 Goldberg ..... 15/167.1
2,668,973 * 2/1954 Glaza et al. ..... 15/167.1
4,712,267 * 12/1987 Cheng ..... 15/167.1
5,350,248 * 9/1994 Chen ..... 15/167.1

FOREIGN PATENT DOCUMENTS

WO 93/14671 * 8/1993 (WO) ..... 15/167.1

* cited by examiner

*Primary Examiner*—Terrence R. Till
(74) *Attorney, Agent, or Firm*—Charles E. Baxley

(57) ABSTRACT

A toothbrush has a plurality of brush segments each of the segments having a small longitudinal length. The brush segments are each embedded with bristles and can be gathered together and straightened in an operative condition for brushing action. Alternately the brush segments are spaced arcuately from each other in a storage condition while not in use, thereby facilitating drying and cleaning of the brush segments. A normally arcuate elastic extension plate is inserted through the brush segments to collect them into their storage condition. A slide member is provided for straightening the arcuate extension plate thereby straightening the brush segments into their operative condition.

4 Claims, 5 Drawing Sheets

TOOTHBRUSH

BACKGROUND OF THE INVENTION

1. Field of the Invention

The present invention relates to a toothbrush and more particularly to a toothbrush which is designed to have a plurality of brush segments. The brush segments are formed conceptualistically by slicing a conventional brush across its length into pieces. Applicant's brush segments are gathered together straight into a brush assembly during brushing and are formed into a curved shape to be spaced from each other while they are not in use, thereby facilitating drying and cleaning bristles of the brush resulting in a sanitary toothbrush.

2. Discussion of Related Art

A toothbrush generally is made from lengths of stiff bristles densely fixed to a brush part formed at a distal end of a handle so that the wet brush part can hardly dry perfectly by shaking it forcefully with a hand after brushing. In addition, the toothbrush can retain water in the brush part due to frequent use and poor ventilation because it usually is kept in a damp bathroom. An experiment reveals that the toothbrush can easily be an unsanitary place welcoming propagation of bacteria.

The densely arranged brush bristles are not easy to free of food particles and the bristles provide the welcome environment for propagation of bacteria. Related prior art brushes are also disadvantageous in that the brush bristles become broken or bent during removal of food particles thereby shortening useful lives of the toothbrushes.

SUMMARY OF THE INVENTION

Accordingly, it is an object the present invention to provide a toothbrush comprising a plurality of brush pieces formed as small segments, wherein the brush segments are mountable on an extension which is normally arcuate and elastic. The brush segments are gathered together during brushing and straightened. When not in use they are preferably spaced from each other thereby facilitating drying and cleaning the brush bristles and hence resulting in a sanitary toothbrush.

To achieve the first object of the present invention, there is provided a toothbrush made from lengths of bristles embedded in brush segments and positioned at a distal end of a handle. The toothbrush includes the plurality of brush segments (visualized by dividing the brush part into small segments), an elastic normally arcuate extension plate is provided to spread out radially the brush segments for drying, and a slide member is provided for straightening the arcuate extension plate to gather the brush pieces together for brushing action.

BRIEF DESCRIPTION OF THE ATTACHED DRAWING

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Hereinafter, the preferred embodiment of the present invention will be described in detail with reference to the accompanying drawings.

Figure 1:
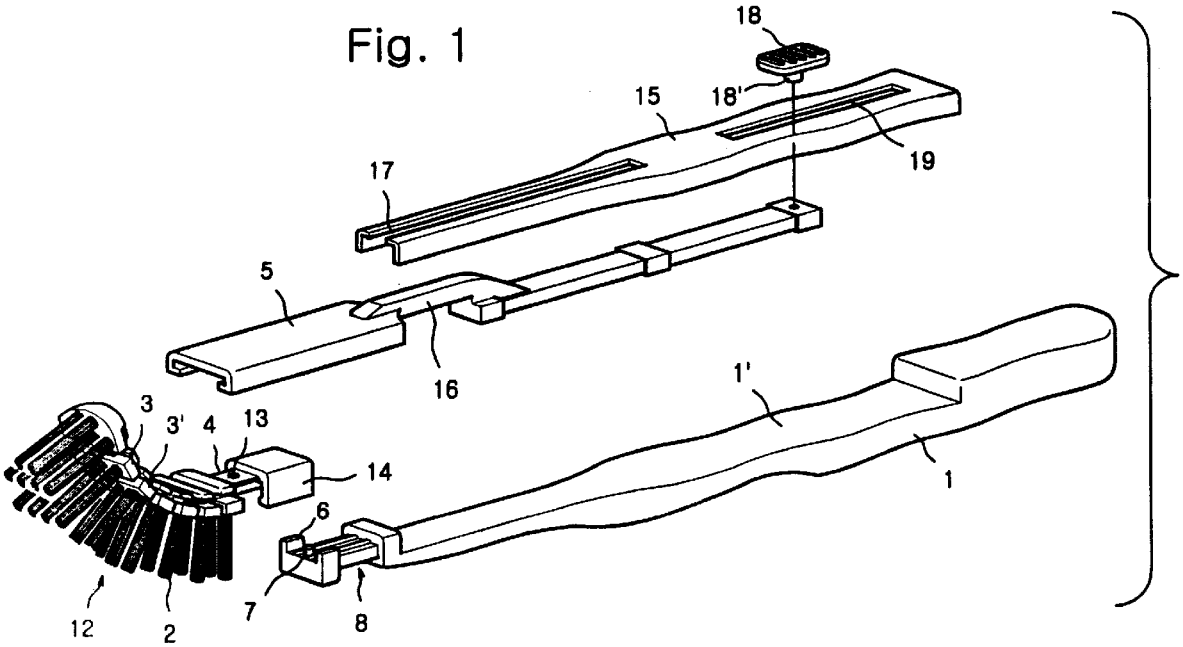
FIG. 1 is an exploded perspective view of a toothbrush according to the present invention.
Figure 2:
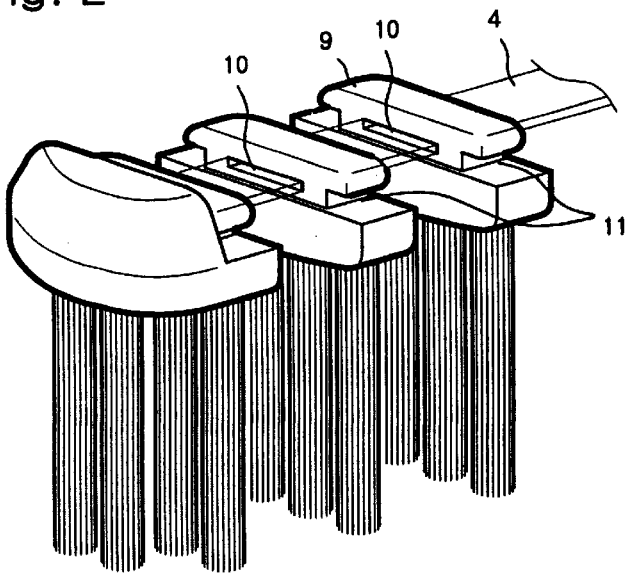
FIG. 2 is a partial view illustrating an example of a brush segment assembly.
Figure 3:
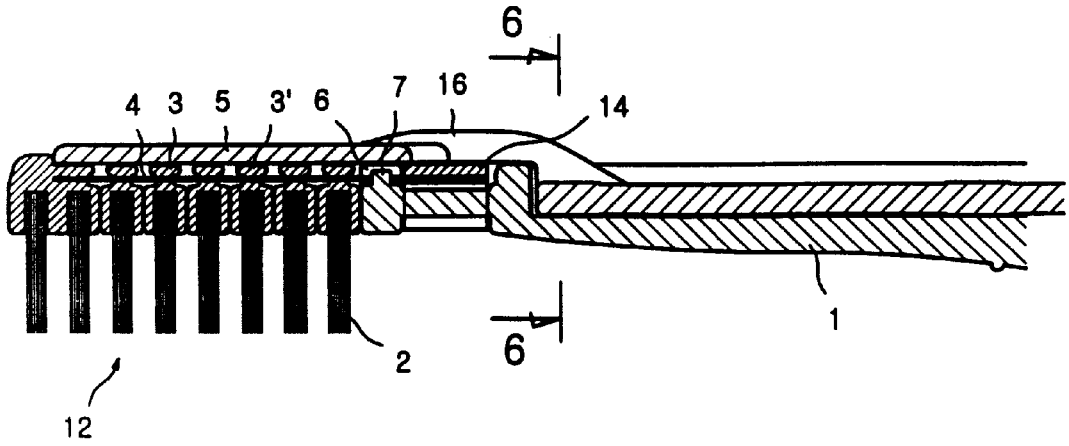
FIG. 3 is an illustrative diagram of a straightened condition of a brush segment assembly arranged for brushing.

FIG. 1 is as exploded view of an embodiment of a toothbrush according to the present invention.

Referring to FIG. 1, a brush segment mounting part 8 having a stopper 6 and a rod 7 attached thereon is formed integrally at a distal end of a toothbrush handle 1. Brush segment 3 and 3' can be likened to transverse slices from an ordinary brush part forming the segments each with lines of bristles 2. The segments in a longitudinal direction have small length. A transverse segment opening 10 and guide grooves 11 are formed in a mountable portion of a brush segment 9 on upper parts of the brush segments 3 and 3'. Into the transverse opening 10 is inserted an extension plate 4, and into the guide grooves 11 is engaged a slide member 5. The brush segments 3 and 3' are grouped with each other to form a brush segment assembly generally designated 12 in such a manner that the extension plate 4 is insertable into the transverse openings 10 extending through the segment bodies 9. The extension plate 4 is provide with a clamp 14 and a fixing hole 13 into which the rod 7 of the brush segment mounting part 8 in the toothbrush holder 1 is inserted.

On a sectional part 1' formed in the upper surface of the handle 1, the slide member 5 is fixedly supported by a fixing cap 15 which is of a size corresponding to that of the sectional part 1' of the toothbrush handle 1. As the slide member 5 is inserted into the guide grooves 11 of the brush segments 3 and 3' and engages the guide grooves 11, arcuate brush segment assembly 12 becomes straightened. The fixing cap 15 is organized with a guide slot 17 and a long slot 19. Into the guide slot 17 is inserted a guide piece 16 of the slide member 5, and into the long slot 19 is inserted a detent 18' of a pusher 18 for moving the slide member 5.

Figure 4:
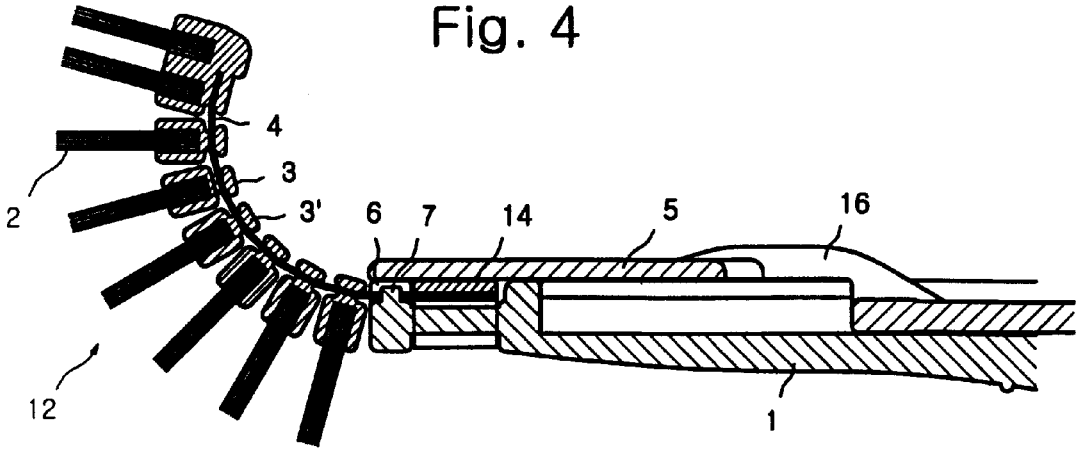
FIG. 4 is cross-sectional view showing the brush segment assembly in an arcuate fanned condition for drying and/or cleaning.
Figure 5:
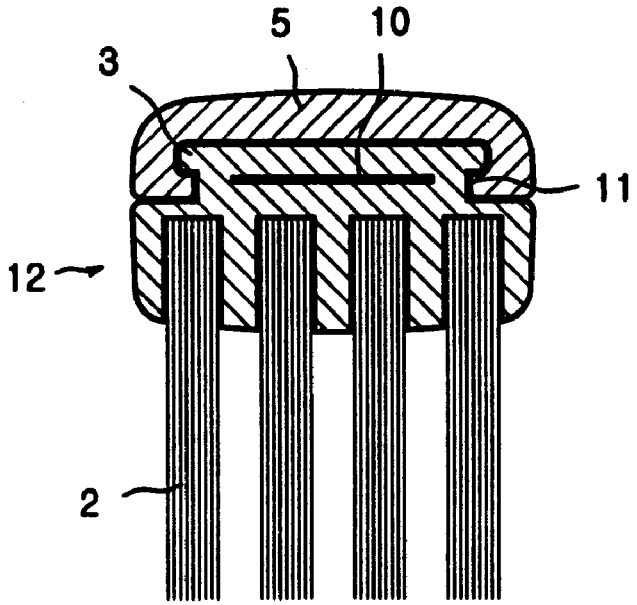
FIG. 5 is a vertical cross-sectional view of a brush segment.
Figure 6:
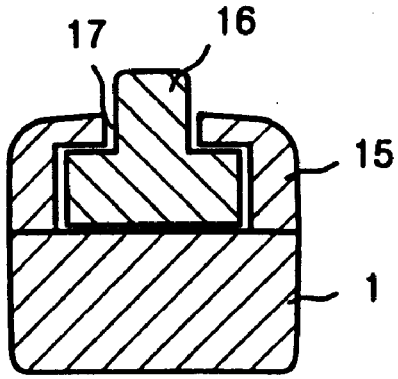
FIG. 6 is a cross-sectional view taken along the line 6—6 of FIG. 3.

In the above embodiment, the brush segment assembly 12 is formed by coupling the brush segments 3 and 3' to simulate an ordinary brush part by means of insertion of the extension plate 4 which is normally exhibits elasticity like a plate spring, each of the brush segments 3 and 3' including at least one line of brush bristles 2 in their longitudinal direction. In such a brush segment assembly 12, as shown in FIG. 4, the brush segments 3 and 3' radially form spaces therebetween owing to the arcuate extension plate 4. However, the brush segment assembly 12 can be firmly fixed at the distal end of the toothbrush handle 1 by means of the stopper 6, the rod 7 by clamping the clamp 14 to the brush segment mounting part 8 formed at the distal end of the toothbrush handle 1 and inserting the rod 7 into the fixing hole 13 in the end portion of the extension plate 4.

The slide member 5 for straightening the brush segments 3 and 3' is provided to allow the guide piece 16 to move along the guide slot 17 of the fixing cap 15, and the detent 18' of the pusher 18 is inserted into the long slot 19. With the pusher 18 extending from the long slot 19 of the fixing cap 15, one can move the slide member 5 toward the distal end of the toothbrush handle 1 engaging the guide grooves 11 formed each of the brush segments 3 and 3' of the brush segment assembly 12, to straighten the bent brush brush segment assembly 12. Thus the slide member 5 combines the brush segments 3 and 3' to be assembled together densely and firmly to brush one's teeth, so that the brush segments 3 and 3' can be used as an ordinary toothbrush without being spaced apart from each other. After brushing, one moves the handle 18 toward a proximal end of the toothbrush handle 1 to position the slide member 5 away from and releasing the brush segment assembly 12 in such a manner that the expansion plate 4 springs to become arcuate again due to its elasticity thereby radially widening spaces between the brush segments 3 and 3'. These widened spaces between the brush segments 3 and 3' accommodate circulation of air therebetween sufficiently to facilitate drying and cleaning of the brush bristles.

As a guide piece 16 moves along a guide slot 17 of the fixing cap 15 and a peg 18' of the pusher 18 is inserted into the long slot 19, the slide member 5 can be moved without deflection to force the brush segment assembly 12 to straighten. According to the present invention, a segment 3 of brush segment assembly 12 with worn-out brush bristles 2 can be replaced by a new brush segment 3. In addition, one can have a more beautiful individualized and personally identifiable toothbrush of one's own by varying colors of the respective brush segments 3 and 3'.

Figure 7:
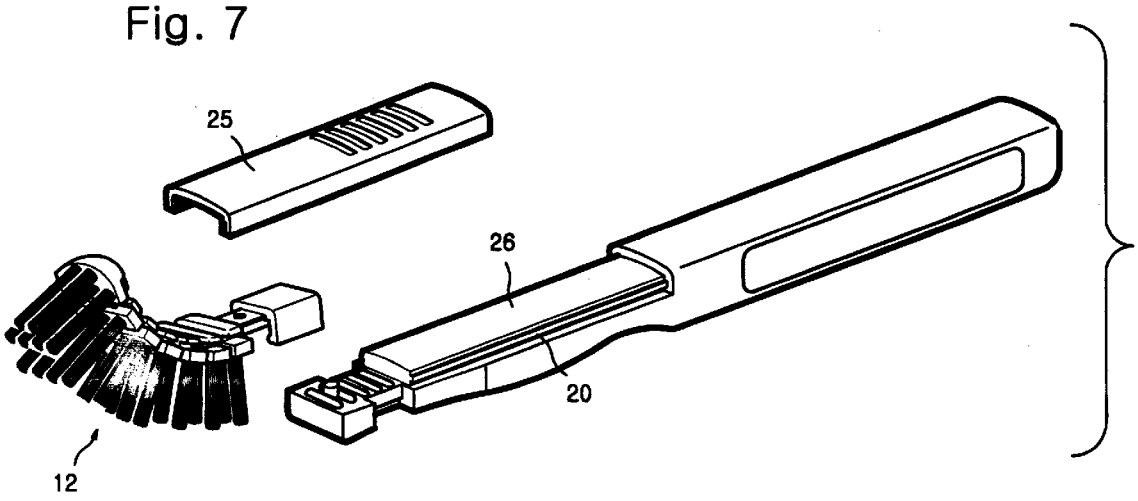
FIG. 7 is an exploded perspective view of another embodiment of the present invention.

FIG. 7 illustrates another embodiment of the present invention in which a slide member in the form of a cover 25 is installed over the brush assembly 12.

Referring to FIG. 7, a sectional part 26 is formed to have a predefined length on an upper surface of the distal end of the toothbrush handle 1 and a guide 20 is formed in a longitudinal direction of the sectional part 26. The slide cover 25 is installed to slide along guides 20 so as to straighten the brush segment assembly 12. Compared to the previously described embodiment, the embodiment of FIG. 7 requires a longer distal end of the toothbrush handle 1 but offers superior functionality.

Figure 8:
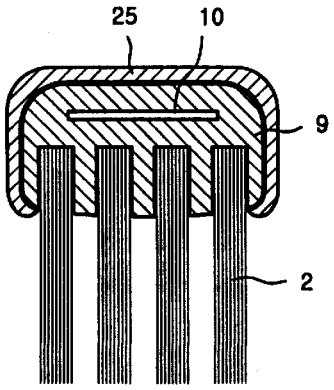
FIG. 8 is a cross-sectional view of a brush segment of the embodiment of FIG. 7 of the present invention.

FIG. 8 illustrates further another embodiment of the present invention in which the slide cover 25 is in position over a body of a brush segment 9.

Referring to FIG. 8, the slide cover 25 has the form of the letter C that embraces the main body 9 to the brush bristles 2. This embodiment of FIGS. 7 and 8 is advantageous in that the brush segment assembly 12 is held straight while embracing the main body 9 and therefore the brush segments 3 and 3' are prevented from swaying.

Figure 9:
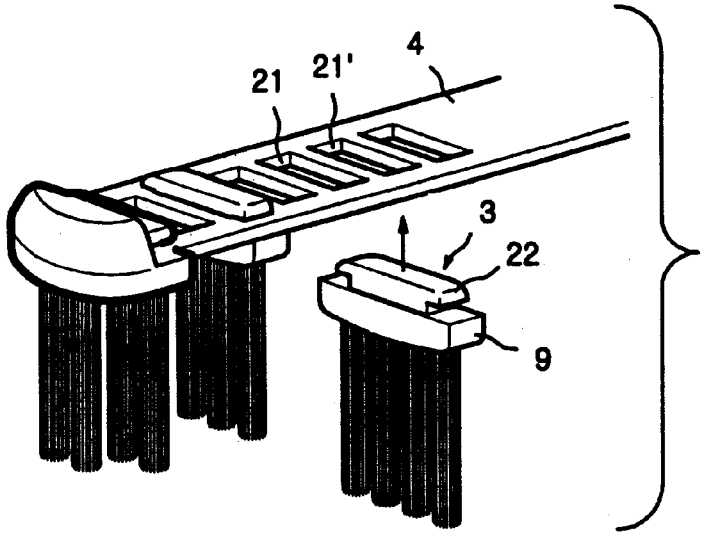
FIG. 9 is a diagram of the still another embodiment of the present invention accommodating replacement brush segments.
Figure 10:
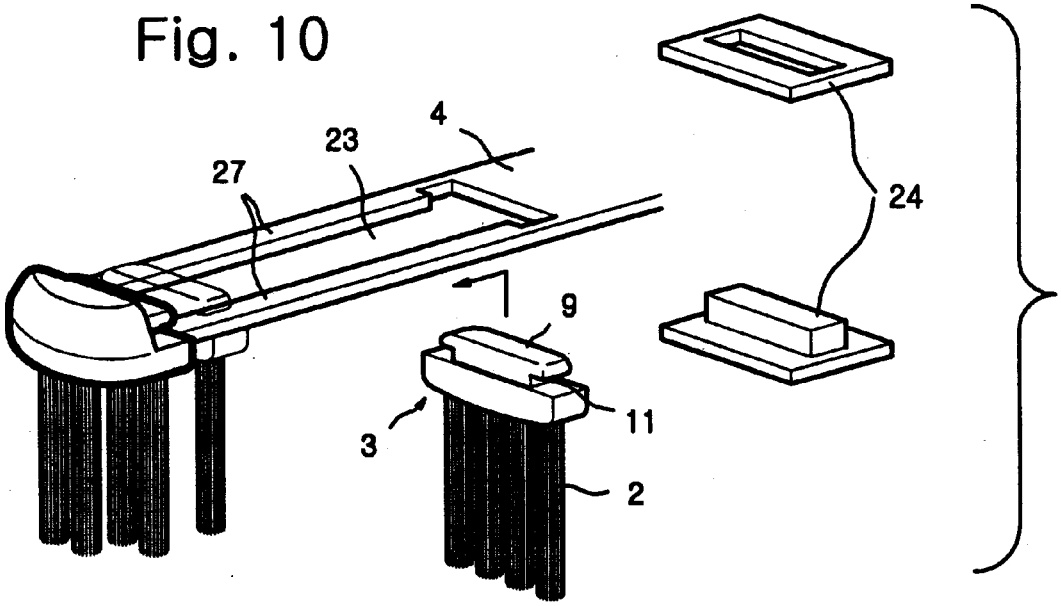
FIG. 10 is a vertical cross-sectional view of still another embodiment of a slide member for accommodating replaceable brush segments.

FIGS. 9 and 10 illustrate still a further embodiment of the present invention wherein the brush segments 3 and 3' are press fit into the extension plate 4.

Referring to FIG. 9, the extension plate 4 to be held by a slide member has coupling holes 21 and 21' spaced from each other. The main bodies 9 of the brush segments 3 and 3' are each provided with a coupling projection 22 to be forced into one of the coupling holes 21, 21'. In this embodiment of FIG. 9, it is possible to remove all or some worn-out brush segments 3 and 3' from the coupling holes 21 and 21' and replace them with others.

Referring now to FIG. 10, the extension plate 4 is perforated with a mounting hole 23 which has a width large enough to receive the brush segments 3 and 3' at an enlarged mouth thereof and has a smaller width that forms shoulders 27. Each main body 9 of the brush segments 3 and 3' is introduced through the enlarged mouth of the mounting hole 23 and then the guide grooves 11 engage the shoulders 27 for positioning the brush segments longitudinally along the mounting hole 23.

As described herein, the present invention provides an economical toothbrush having a plurality of brush segments 3 and 3' to form a brush segment assembly with brush bristles 2 embedded therein, the brush segments are gathered together and straightened by means of extension plate 4 and the slide members 5, 25. The toothbrush can be kept with spaces between the brush segments 3 and 3' widened while it is not used. This condition facilitates rapid drying and cleaning of the toothbrush bristles and makes it possible to keep the toothbrush clean and sanitary. The toothbrush also makes it possible to replace all or some worn-out brush segments with new ones, and to code individual toothbrushes of those who cohabit a household.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

I claim:

1. A toothbrush comprising:

a plurality of individual brush segments juxtaposed at a distal end of a handle, each of the brush segments having bristles embedded therein;

each of the brush segments forming a segment opening, the segment openings aligned to receive therethrough an extension plate to collect the brush segments into a brush assembly;

the extension plate having a normally arcuate shape to separate radially the brush segments from each other for drying and cleaning of the bristles;

a slide member operatively connected to the handle and movable between a use condition, wherein the slide member projects from the handle to straighten the extension plate thereby readying the brush assembly for use, and a storage condition, wherein the slide member retracts toward the handle to allow the extension plate to resume its said normal arcuate shape for the drying and cleaning of the bristles;

a plurality of coupling holes provided in the extension plate and spaced from each other, each of the brush segments provided with a coupling projection integrally formed therewith, each of the coupling projections being forceably engageable into a corresponding one of the coupling holes.

2. The toothbrush as claimed in claim 1 wherein the slide member surrounds the entirety of each of the mountable portions of the brush segments.

3. A toothbrush comprising:

a plurality of individual brush segments juxtaposed at a distal end of a handle, each of the brush segments having bristles embedded therein;

each of the brush segments forming a segment opening, the segment openings aligned to receive therethrough an extension plate to collect the brush segments into a brush assembly;

the extension plate having a normally arcuate shape to separate radially the brush segments from each other for drying and cleaning of the bristles;

a slide member operatively connected to the handle and movable between a use condition, wherein the slide member projects from the handle to straighten the extension plate thereby readying the brush assembly for use, and a storage condition, wherein the slide member retracts toward the handle to allow the extension plate to resume its said normal arcuate shape for the drying and cleaning;

the extension plate forming a mounting slot, the mounting slot having an access opening large enough to receive a mountable portion of each of the brush segments, the mounting slot also provided with a smaller opening forming shoulders to engage the mountable portion of each of the brush segments, the mountable portions of each of the brush segments arranged for sliding along ridges formed in the shoulders for guiding the brush segments into operative positions, a cap engageable to cover the mounting slot when the brush segments are in said operative positions.

4. The toothbrush as claimed in claim 3 wherein the slide member surrounds the entirety of each of the mountable portions of the brush segments.

* * * * *